US008132650B2

(12) United States Patent
ShterenBerg

(10) Patent No.: US 8,132,650 B2
(45) Date of Patent: Mar. 13, 2012

(54) SYSTEM FOR SAFE DESCENT OF PEOPLE OR CARGOES

(76) Inventor: Yuriy ShterenBerg, Needham, MA (US)

( * ) Notice: Subject to any disclaimer, the term of this patent is extended or adjusted under 35 U.S.C. 154(b) by 0 days.

(21) Appl. No.: 10/389,894

(22) Filed: Mar. 17, 2003

(65) Prior Publication Data

US 2004/0182645 A1 Sep. 23, 2004

(51) Int. Cl.
*A62B 1/00* (2006.01)

(52) U.S. Cl. ..... 182/192; 182/11

(58) Field of Classification Search ..... 182/10, 182/11, 5, 191–193
See application file for complete search history.

(56) References Cited

U.S. PATENT DOCUMENTS

| | | | | |
|---|---|---|---|---|
| 311,039 | A * | 1/1885 | Scheidt et al. | 182/5 |
| 666,879 | A * | 1/1901 | White | 188/65.3 |
| 2,976,955 | A * | 3/1961 | Huber | 188/65.1 |
| 3,739,875 | A * | 6/1973 | Clark-Padwicki | 182/6 |
| 4,256,199 | A * | 3/1981 | Sellards | 182/11 |
| 5,738,339 | A * | 4/1998 | Kuryu | 254/267 |
| 6,962,235 | B2 * | 11/2005 | Leon | 182/73 |

* cited by examiner

*Primary Examiner* — Alvin Chin Shue

(57) ABSTRACT

A device for the safe descent of people or cargo along the cable, for example, for the salvation of people in case of fire in high-rise building. To provide the salvation of a few people during the same rescue operation, the device ensures movement along the cable in both directions, downwards and upwards. There is no need for any extensive preparation before using the device. The cable, with or without a handing device, is fixed in the point of lowering, dropped downwards with the weight and then is reeled three times upon the contact disk. Such connection ensures moving the contact disk along the cable without sliding.

6 Claims, 7 Drawing Sheets

SYSTEM FOR SAFE DESCENT OF PEOPLE OR CARGOES

BRIEF SUMMARY OF THE INVENTION

The present invention relates generally to a rescue device and, more specifically, to the device for the safe descent of a person or group of people being rescued from the upper floors or roofs of high-rising buildings on fire. To prepare the device for descent, none of the following are necessary: substantial physical effort, an outer sours of energy, a preset stationary mechanisms. A cable is used as a channel for the movement. Used as a way of the contact disk, the device with the cable is simple, foolproof, and useful. The device can be easily converted into the mode ascent to lifting himself which significantly expands its capabilites.

a. The primary goal of the present invention is to provide a rescue means that will overcome the shortcomings of the prior devices.

b. An important goal of the present invention is to provide a device which can be used repeatedly during the same rescue operation in order to rescue a number of people.

c. A further object of the present invention is to provide the same contact the device with the cable for both descent and ascent mode.

d. A still further object of the present invention is to provide convenience and reliability of the switching operation mode of the device

DETAILED DESCRIPTION OF THE INVENTION

A preferred embodiment of the device for safe descent of people or cargo of the present invention is illustrated in FIG. 1, FIG. 2, FIG. 3, FIG. 4, FIG. 5, FIG. 6, FIG. 7.

Figure 1:
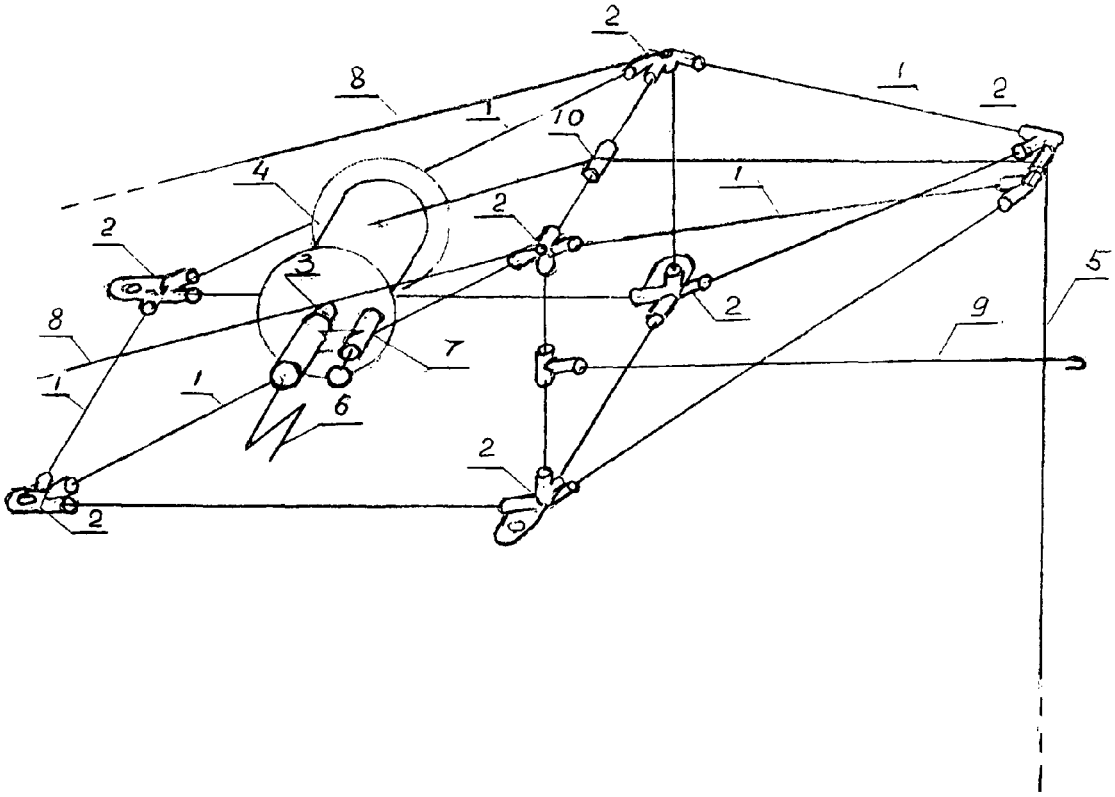
FIG. 1 is a schematic view of the hanging device in accordance with the present invention.

The hanging device on FIG. 1 is installed on the roof of a high-rise building or on any upper floor of the same building near a window. The device consists of pipes 1 and plugs 2, made_in duralumin, two half-axis 3 for a drum 4 with the cable 5, a steel handle 6, a stopper 7, and a stretching 8. All these elements are included in the standard complete set of this invention. The frontal part of assembled in toto hanging device ensures some distance between the cable descends from external axis and the wall of the building. A controlling lever 9 is used for approach the upper part of the dropped cable to the descending person for connection. The device is fixed by crutches or self-cut bolts through a stop bearing on some part of the roof or the floor. The stretching connects the hanging device to some strong pieces of the roof or of the floor, so the device is additionally secured from shifting or moving. After this, the drum is stopped and the handing device is ready to use. In special cases the upper end of the cable could be just fixed upon the strong construction of the roof or the apartment without the hanging device The type of the cable is the one usually used by speleologist and in rock climbing. This is multicore flexible little-winding cable with outboard diameter of 3.8-4.2 mm. One hundred meter of such cable weights 9.6 kg, cable's breaking strength is about of 1000 kg.

Figure 2:
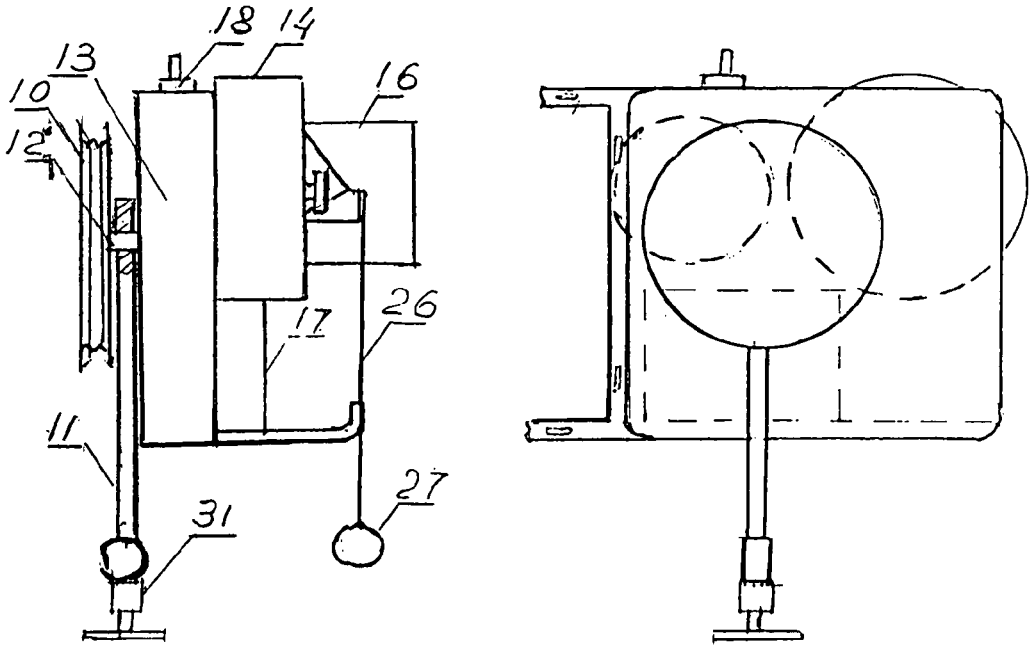
FIG. 2 is schematic projections of the device for control movement along the cable in accordance with the present invention.

FIG. 2 shows the schematic composition of the main parts of the device. The device functionally consists of a contact disk 10, a stabilizing lever 11, an axis 12 of the contact disk, a gearbox 13, an electric friction brake 14, a manual drive 15 of the brake, an engine-generator 16 reversible unit, an accumulator 17, and a switcher 18.

The contact disk 10 is made from cilumin and consists of two walls and two grooves divided by cylindrical surface; the width of that surface is equal to the diameter of the cable. To increase the friction coefficient between the cable and the contact disk, cylindrical and groove surfaces are corrugated. Tree cable turns on such contact disk construction provides compact and reliable connection between them during the movement of the disk under the cable. Described connection the device with the cable without sliding provides, by means controlled rotation speed of the control disk, the maintenance of speed of downwards movement and reliable movement up.

The stabilizing lever 11 consists of a pin to turn freely on the axis of the contact disk, duralumin tube rode at the other end of which there is a ring. On one side of the ring there is a spring latch to insert the cable into the ring and on the top of the ring installed limit switch 31 issuing a signal identifying the device in the uppermost. To provide reliable contact limit switch with extreme axis of the hanging device on the plunger of the switch fixed a washer.

Figure 3:
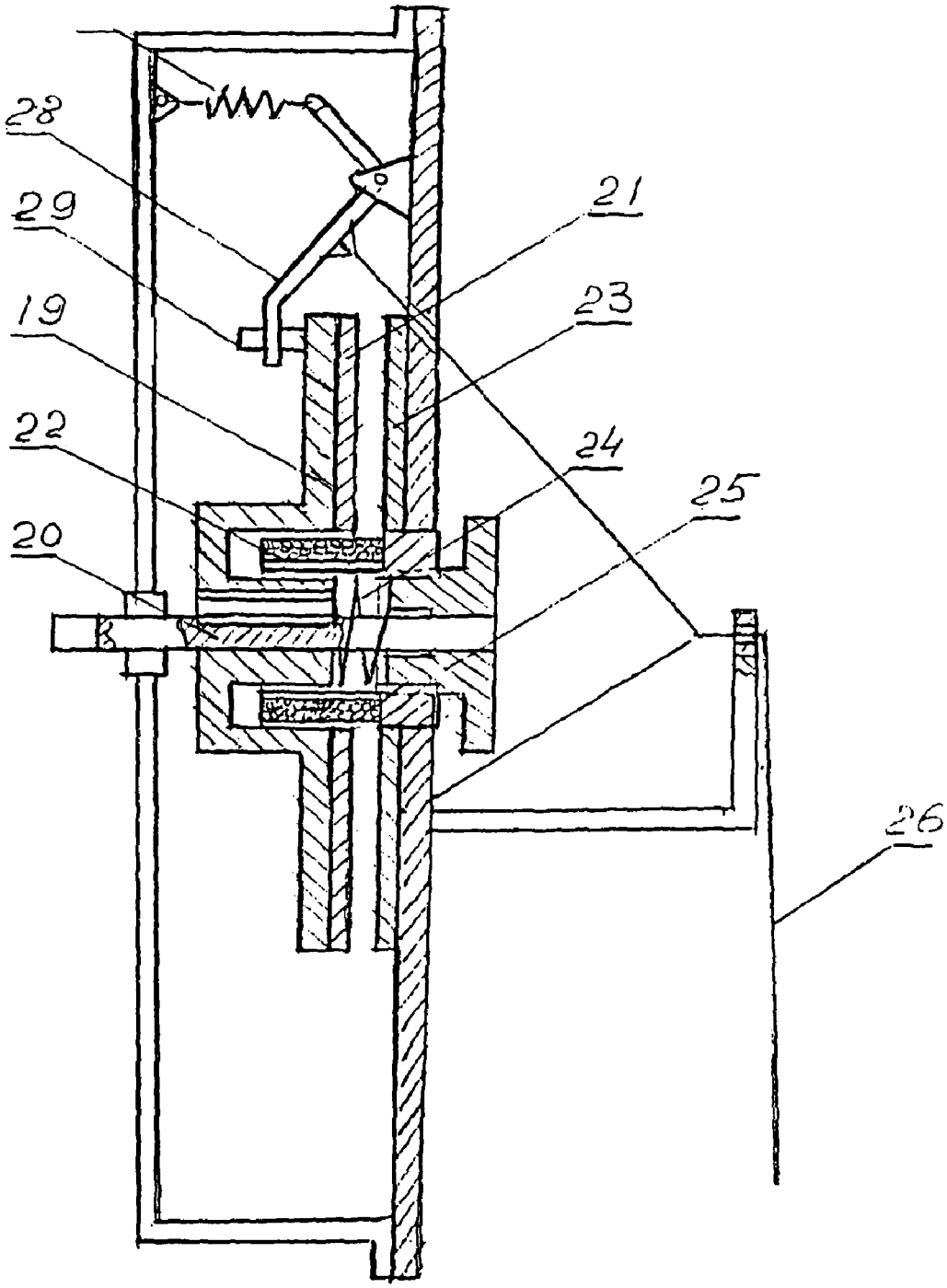
FIG. 3 is a schematic drawing of the electric frictional brake of the device for control movement along the cable in accordance with the present invention.
Figure 4:
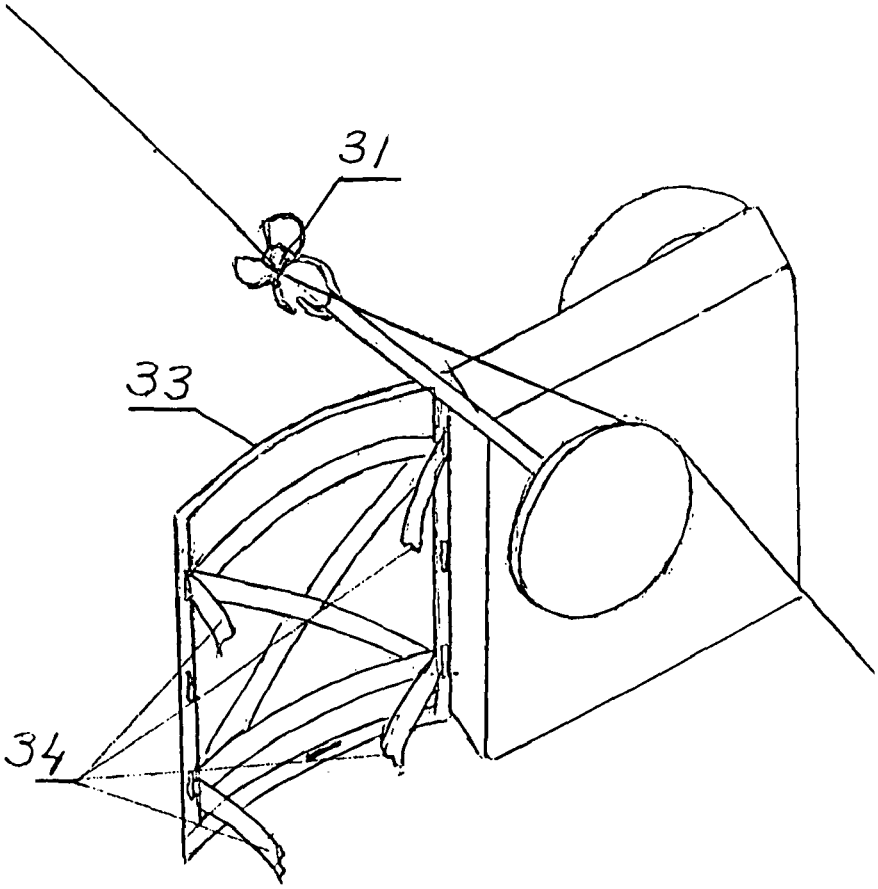
FIG. 4 is a schematic view of connection a cable with the device for control movement along the cable in accordance with the present invention.
Figure 5:
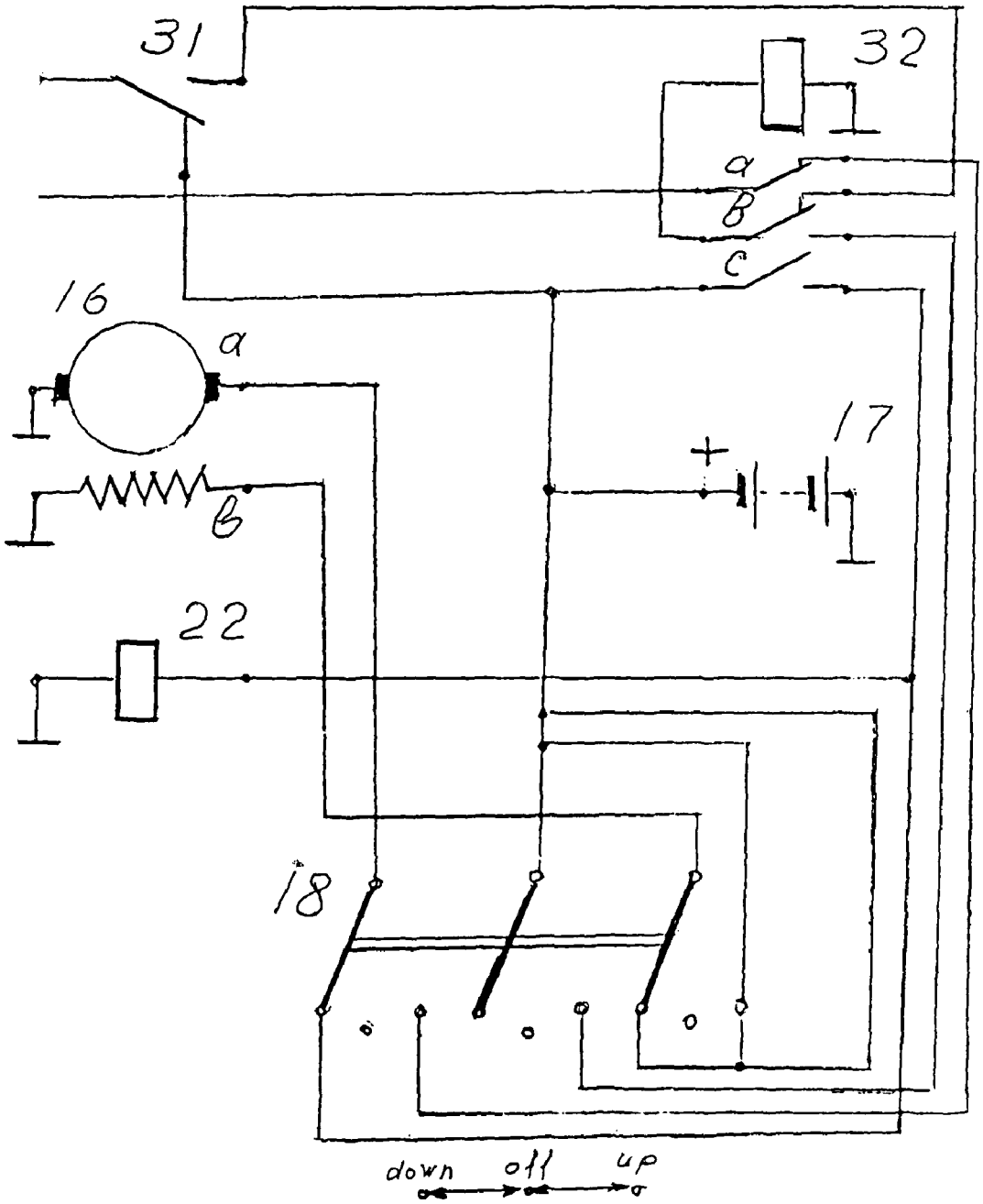
FIG. 5 is an electric circuit of the device for control movement along the cable in accordance with the present invention.
Figure 6:
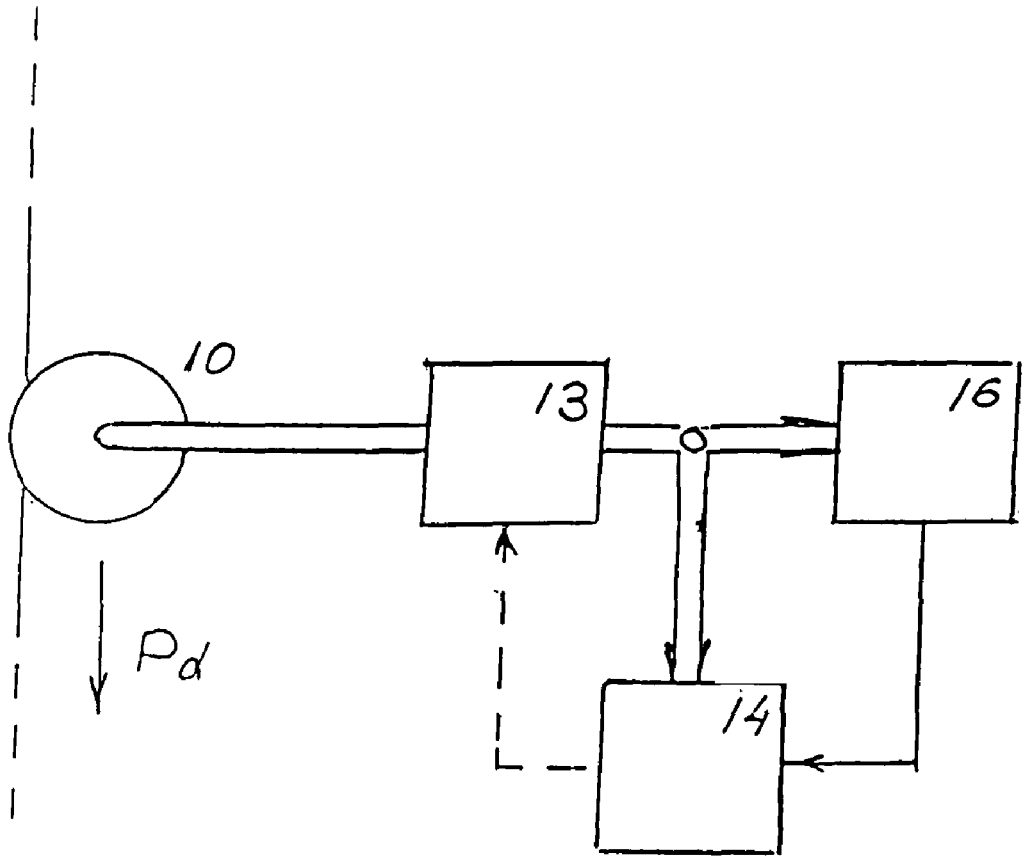
FIG. 6 is a block diagram of an automatic control system descent speed of the device for control movement along the cable in accordance with the present invention.
Figure 7:
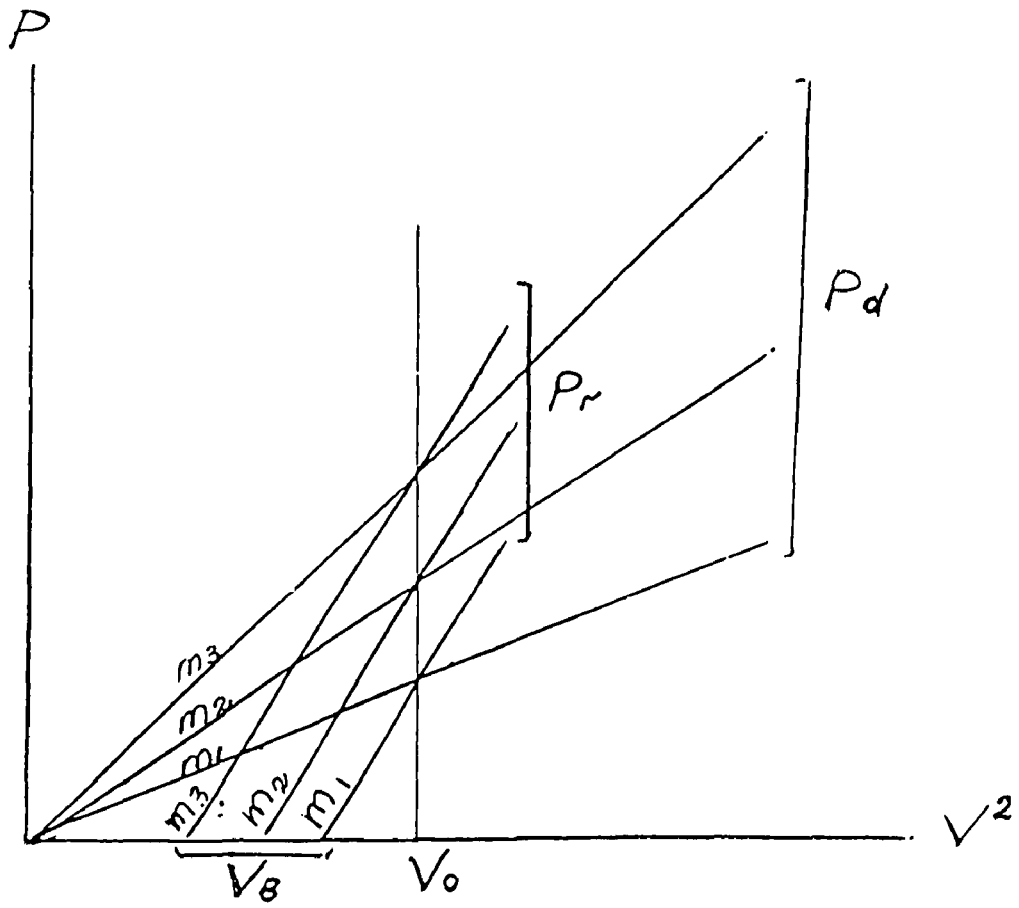
FIG. 7 is characteristic curves clarifying the principle of stabilization of speed the device for control movement along the cable in accordance with the present invention.

FIG. 3 shows a schematic variant of the electric friction brake. A solenoid anchor 19 is installed on the axis of the brake 20 and creates common unit with a movable disk 21 of the brake. It revolves together with the axis 20 and can shift along with this axis under influence of the magnetic field of the solenoid coil 22. The coil is connected to the output of the generator, one of the modes of the reversible unit 16. The attraction of revolving movable disk 21 to the immovable disk 23 creates effect of the braking. A spring 24 hinders contact of disks. The force of counteraction of spring is regulated by an adjusting bolt 25, which is scaled in kg (pound) of the weight of the descending person. The movable disk can approach to the immovable one also under influence of the manual drive. It consists of a cable 26 with a ring 27 for person, three levers 28 with rollers 29 and springs 30. The levers are pressed to the outer surface of the movable disk through the rollers by the springs.

In mode generator, the voltage of the reversible unit output up to 12 v dc at 900 rpm. In mode engine, the reversible unit consumes power of 200 w at the voltage of 12 v dc and 900 rpm. As a reversible unit consisting of an anchor 16*a* and coil excitation 16*b* is used collector dc motor with separate excitation.

The gearbox 13, functioning as a connecting link of the device, built on the basis of gear transmission. It binds the axis of the control disk with the shafts of the reversible unit and the electric friction brake. It increases the rotation speed of the movable brake disk and the shaft of the generator in re the speed of the contact disk or decreases the rotation speed of the contact disk in re the speed the shaft of engine. The rotation speed shaft of the reversible unit and electric friction brake are equal to each other. The coefficient of the transmission of the gear-box chosen equal of 20:1.

An accumulator 17 of 12 v is used to provide power ascent mode device and excitation of the generator mode reversible unit. The accumulator's capacity for this purpose must be at least 200 watt×hours. The accumulator of type Li-Ion has specific capacity of 200 watt×hours/kg. The table below shows the number of ascents which the device can perform without any additional loading against weight of accumulator W and height of ascent H

| | H m | |
|---|---|---|
| W kg | 100 | 200 |
| 1 | 8 | 4 |
| 2 | 16 | 8 |

The calculation was performed under the stipulation that the effectiveness of the motor is 50% and the capacity of the accumulator at the end of ascent could not be less than 50%.

The electric circuit (FIG. 5) explains interaction electric parts of the device. The mode the device is installed using three-position switch 18. In the "off" (central position of the switch) the accumulator disconnected from all objects of power consumption. In this position the device must be in the mode of storage, transport and before switchover the device from one mode to another. In position "down" the device is switched in mode descent while the reversible unit works as the generator. For this, the coil excitation 16*b* is connected to the power (to the accumulator terminal "+") and rotor 16*a* to the solenoid coil 22. In position "up" the device is switched in mode ascent and the reversible unit works as the engine. The rotor 16*a* and the coil excitation 16*b* both are connected to the power, but the coil excitation is connected direct and the rotor trough normally closed contact of limit switch 31 and contact "a" of relay 32. When the limit switch 31 through the plunger washer touches the extreme axis of the hanging device the contact of this switch cuts power to the rotor and switch the relay 32. The relay through contact "b" connects itself to the power, contact "a" disconnects the rotor with the limit switch, and contact "c" connects solenoid coil to the power. The engine stops and the electric friction brake 14 instantly stops the movement the contact disk along the cable. After the device will be hitch by the controlling lever 9 on the roof, the limit switch passes to its initial position. A next descending person sets the switcher 18 in position "off" resulting in the relay 32 is disconnected from power and its contact "c" is de-energized the solenoid coil 22. The device is ready to new descent.

The device realizes an automatic control system for maintenance the prescriber speed of descent. The control contour (FIG. 6) includes the contact disk (10) moving along the cable, reversible unit (16) in mode generator as a speedometer, and electric friction brake (14) which is affecting the output shaft of the gearbox control the rotation speed of the contact disk. To ensure the maintaining of the prescribed speed, the process of controlling should be administered accordance to dependencies shown in FIG. 7: dependencies the kinetic power Pd of the downwards movement and the power Pr of braking against the speed squared V2 of the descent. The more weight of the person the more slope steepness of the characteristic Pd(V2). The real dependency Pr(V2) is determined by the particular characteristics of a real electric friction brake. But it is obvious that Pr should grow monotonously with the increase of the speed and so this dependency conventionally may be introduce in working range of the speed as linear. To automatic control it is necessary fulfill two conditions: first, the slope steepness of the Pr must be bigger than the steepness of the Pd and, second, the dependency Pr(V2) must be displaced re zero. This is accomplished by the adjusting system. At the speed Vb the disks of the brake start contacting each other. The more the force of counteraction, than greater the speed Vb. The choice of Vb is determined by the weight m of the descending object and provided by the adjusting bolt 27 scaled of mkg. The crossing Pd(Vo2) and Pr(Vo2) depends of amount of m. On FIG. 8 are given characteristics for three different weight m1, m2, m3, while m3>m2>m1. The speed Vo is stable because, if V>Vo braking power Pr will be greater than kinetic Pd and the movement slows down, but if Vo>V the ration of the powers changes and movement accelerates. Hence, the stabilization of the descent speed is acquired.

In case of emergency (fire) and without the possibility of using upstairs or elevators a person (persons) take a decision about applying of the device and about the mode of the mount the cable. The free end of the cable is attached a counterbalance weight of about 3 kg and the counterbalance is lowered to one meter above the ground. This counterbalance is performed function of the small force that could hold large force (a weight of an object+the device) without sliding if the cable is wound round on the contact disk not less than ascertained times. The descending person puts on the device by the belts 31 with the fasteners of the frame 33 (FIG. 4) and clamps the device to the cable. For this purpose, the person makes three tight revolution of the cable on the contact disk, about two meters of the cable, inserts the cable into ring of the stabilizing lever 11 which freely turns on the axis 12. The person switches the switcher 18 in position"1" and comes to the edge of the roof or the window and leaves it. Under the influence of the gravity the speed of the person descent begins to increase. The value of the generator output tension being proportional to the speed increases also. The magnetic field of the solenoid overcomes the resistance of spring and presses the movable disk to the immovable one. The balance of the forces is obtained at the prescribed level of the descent speed about 0.5 msec. The process stabilization the speed of the descent starts.

The descending person has to apply some effort while using the manual drive of the brake for extra or emergency slowing down. In this case the person has to pull down the ring 27 of the drive.

On reaching a landing site, the person switches the switcher 18 in position "off", unfastens the belts, free himself from the device, and, if the using of the device is finished, he unplugs the device from the cable.

For people living or working on the high floors the presence of such device makes it possible to save themselves and the members of their family or employees of the office. Along one cable the people with devices can descent one after other, but to save some people from the same place by one device only, it is necessary to use ascent mode of the device. For this, a descended person after landing has to check the connection device with the cable and the presence of weight on the cable end, and send the device itself up on the same cable to a place where people start to descent by switch the switcher 18 in position "up".

A device for the safe descent of people or cargo along the cable, comprising a hanging device, a contact disk, a stabilizer lever, an engine-generator reversible unit, an electric friction brake, a gearbox, a drive of the manual brake, and an accumulator.

a. An engine-generator reversible unit is converted from the engine of direct current into a generator of direct current and back; in the mode of generator the reversible unit feeds an electrical frictional brake and provides operation of the device in mode of the descent; in the mode of engine the reversible unit is powered by an accumulator and provides operation of the device in mode of the ascent.

b. In the mode of descent the device is organized as a closed loop automatic stabilization of the speed of descent; the closed loop consists of the contact disk connected through a gearbox with the shafts of the reversible unit in the mode of the generator and an electric friction brake.

c. In mode of ascent the reversible unit working in mode of engine is connected to the accumulator and trough the gearbox rotates the contact disk and the movable disk of the electric frictional brake; the contact disk moves up the device along the cable.

d. In mode of ascent the solenoid coil of the brake is connected through a switcher and a limit switch to the accumulator; at the uppermost position of the device turns off engine and connects power to the solenoid coil; the device safely stops.

I claim:

1. A device for controlling descent of people and/or cargo along a cable, comprising: a contact disk, a gear-box, a brake unit, a generator of electric current, a means for activation of said brake unit, and a means for setting up the device, said device attached to an object that descends; said contact disk engaged with and movable along said cable; said gear-box having an input shaft connected to and rotated by an axle of said contact disk, and an output shaft of said gear-box; said brake unit having an axle connected to said output shaft of said gear-box including immovable and movable friction means capable to be engaged; said generator connected to and activated by said output shaft of said gear-box generating electric current which magnitude depends on speed of descent of said object; said means for activation said brake unit fed by electric current generated by said generated, converting said electric current into a force that presses said movable friction means of said brake unit against said immovable friction means which reduces speed of rotation of said contact disk; said means for setting up the device providing a stable speed of descent of said object; said means for setting up the devise includes, an adjusting spring and a bolt scaled by weight providing suitable tension of said adjusting spring and thus stabilizes the descent.

2. A device according to claim 1, wherein said engagement of said contact disk and said cable prevents sliding of said disk about said cable.

3. A device according to claim 2, wherein said contact disk has groove(s) capable of accommodating said cable.

4. A device according to claim 3, wherein said engagement of said cable and said contact disc is provided by placing said cable into said groove and coiling the cable around the contact disk.

5. A device according to claim 4, including also a counterbalance attached to said cable below a point of engagement of said contact disk.

6. A device according to claim 1, including a means for safely slowing down the speed of descent of people by manually increasing pressure of said movable friction means of said brake unit against said immovable means.

* * * * *